United States Patent [19]

Dixon

[11] 4,052,920

[45] Oct. 11, 1977

[54] MACHINE FOR PERFORATING HIGH DENSITY POLY-ETHYLENE FILM OR THE LIKE FILM MATERIAL

[75] Inventor: Vernon Gerald Ralph Dixon, Wisborough Green, England

[73] Assignee: Paclene Company Limited, Ennis, Ireland

[21] Appl. No.: 719,482

[22] Filed: Aug. 31, 1976

[30] Foreign Application Priority Data

Sept. 1, 1975 Ireland ..... 1907/75

[51] Int. Cl.[2] ..... B26F 1/24

[52] U.S. Cl. ..... 83/337; 83/346; 83/660

[58] Field of Search ..... 83/337, 346, 347, 660

[56] References Cited

U.S. PATENT DOCUMENTS

| | | | |
|---|---|---|---|
| 465,427 | 12/1891 | Cox | 83/337 |
| 898,193 | 9/1908 | Davidson | 83/337 |
| 3,546,742 | 12/1970 | Kugler | 83/660 UX |
| 3,735,659 | 5/1973 | Button | 83/660 X |

*Primary Examiner*—Willie G. Abercrombie
*Attorney, Agent, or Firm*—Sughrue, Rothwell, Mion, Zinn and Macpeak

[57] ABSTRACT

A machine for perforating high density polyethylene film comprising a feed roller, cooperating male and female rollers between which the film passes for perforation and a take-up roller for receiving the perforated film material. A plurality of blade members are housed within the male roller and under the influence of adjustable indexing means are adapted for reciprocal motion relative to the surface of the male roller. In the vicinity of the female roller preselected ones of the blade members are caused to project from the surface of the male roller and to enter a complementary recess in the female roller to perforate the film material as it passes between the male and female rollers. The longitudinal distance between the perforations on the film is determined by the selection of blade members caused to project from the male roller during each revolution of the male roller.

5 Claims, 7 Drawing Figures

Fig. 1.

MACHINE FOR PERFORATING HIGH DENSITY POLY-ETHYLENE FILM OR THE LIKE FILM MATERIAL

This invention relates to a machine for perforating high density polyethylene film or the like sheet material.

Known constructions of machines for perforating film material are in general of complex construction and suffer from the disadvantages inherent with complex machinery namely high maintainance and spare part costs. Additionally the known machines only operate at relatively low speeds and yet do not produce a consistently good quality product. It is an object of the present invention to overcome the stated disadvantages of the known machines by providing a machine of relatively simple construction which can operate at high speed.

Accordingly the present invention provides a machine for perforating high density polyethylene film or the like film material, comprising a feed roller for supplying film material to be perforated from a roller thereof, cooperating male and female rollers between which film material from the feed roller passes for perforation and a take up means for receiving the perforated film material. A plurality of blade members are provided, each mounted for reciprocal motion relative to the surface of the male roller between a first position wherein the blade member projects from the surface of the male roller and a second position wherein the blade member is retracted into the male roller. An adjustable indexing means is provided which cooperates with the blade members such that, at least in the vicinity of the female roller, preselected ones of the blade members are caused to project from the surface of the male roller and the non-selected blade members are caused to be in the retracted positions, whereby in use a preselected blade member projecting from the surface of the male roller enters a complementary recess in the female roller to perforate film material passing between the said male and female rollers.

In an embodiment of the invention it is possible to adjust the spacing of the perforations in the film material. This is achieved by suitably adjusting the indexing means.

The invention will be understood from the following description of a preferred embodiment thereof given by way of example only with reference to the accompanying drawings in which.

Figure 1:
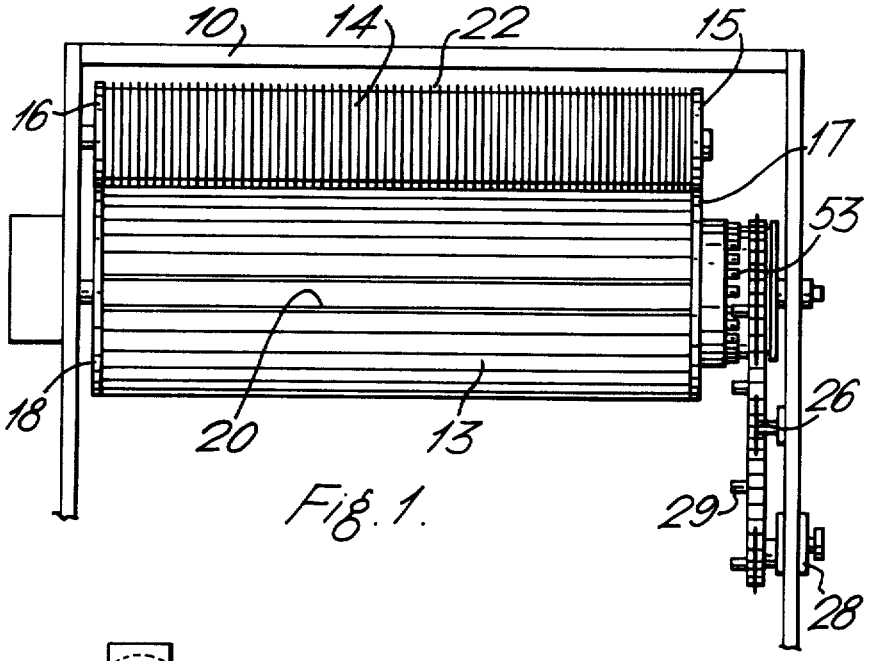
FIG. 1 is a diagrammatic front view of a first embodiment of a machine according to the present invention, the support structure and conventional drive mechanisms being omitted for the sake of clarity.
Figure 2:
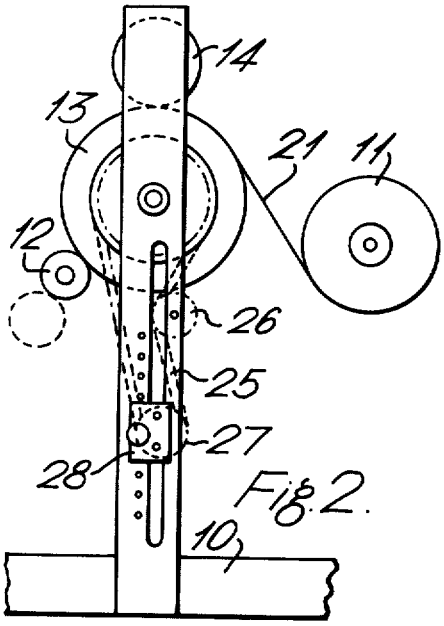
FIG. 2 is a diagrammatic side view of the machine of FIG. 1.
Figure 3:
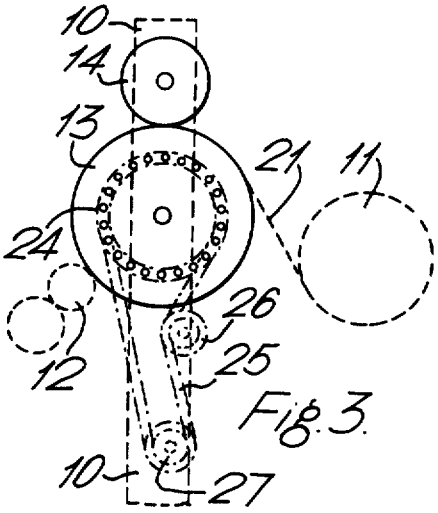
FIG. 3 is a diagrammatic detail side view of the male roller indexing mechanism.
Figure 4:
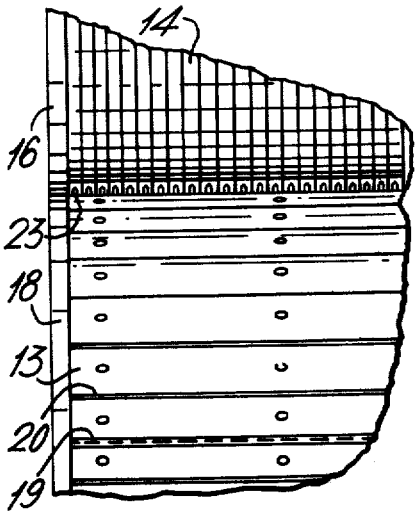
FIG. 4 is a partial front view of the mating of the male and female rollers.
Figure 5:
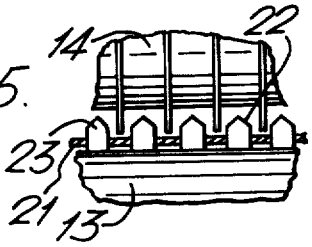
FIG. 5 is an enlarged detail of the mating of a blade member on the male roller with a recess on the female roller.

Referring to the accompanying drawings there is illustrated a machine for perforating high density polyethylene film. The machine comprises a frame structure 10 having supported thereon and located in an operative position thereon a film feed roller 11, for supplying film material to be perforated from a roll thereof, a film take-up roller 12, and cooperating male and female rollers 13 and 14 respectively. The film take-up roller 12 and the male roller 13 are driven rollers and the drive means is a conventional electric motor (not shown). The feed roller 11 is an idler and the female roller 14 is directly geared through gears 15 and 16 and gears 17 and 18 to the driven male roller 13. In use, the film material 21 passes between the male and female rollers for perforation, as shown.

The male roller 13 is a hollow drum and houses a plurality of blade members 19 disposed parallel to the axis of the male roller and which are operatively associated with an indexing mechanism incorporated within and at one end of the roller 13 and to be described later. The male roller 13 is provided over its surface with a plurality of spaced-apart slots 20, which are arranged directly above respective blade members 19 housed within the roller 13. Each blade member 19 is mounted for reciprocal motion relative to the surface of the male roller 13 between a first position wherein the blade member projects above the surface of the roller through a respective slot 20 and a second position wherein the blade member is retracted below the surface of the male roller.

Figure 6:
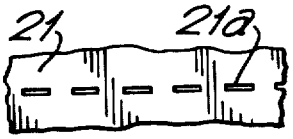
FIG. 6 is a view of a longitudinal line of perforations as applied by the machine of FIGS. 1-5 of the accompanying drawings to a sheet of film or the like sheet material.

In operation the indexing mechanism, which is adjustable as will be described hereafter, is set so that in the vicinity of the female roller preselected blade members 19 are pushed outward of the roller 13, against the force of a biasing means tending to keep them retracted, to project through a respective slot 20 to perforate film 21 passing between the male roller 13 and the female roller 14, those blade members 19 not selected by the indexing means remaining retracted. It will be noted that in this embodiment the surface of the female roller 14 is so formed to give a continuous series of circular recesses 22. These recesses 22 are complementary to and, in use, receive the perforating blade heads 23 of the blade members 19. Each preselected blade member 19 produces a line of individual perforations **21*a* transverse the film 21 as shown in FIG. 6. The above mentioned blade member indexing mechanism comprises a chain and pulley system operatively associated with a series of actuating plungers 53 connected to respective blade members 19 by respective linkages to be described later with reference to FIG. 7. The chain and pulley system consists of a chain 25, an idler pulley 26 and an adjustable pulley 27 mounted on a slide block 28 which is itself mounted on the support frame 10. The chain 25 carries a number of spaced-apart studs 29. In use the chain 25 and its studs 29 are chosen to suit the desired perforating operation, i.e. to provide the desired distance between any two lines of perforations 21*a* to be applied across the sheet of film 21, by choosing the positions of the studs 29 on the chain such that on rotation of the male roller 13 the studs are brought in turn opposite respective ones of the actuating plungers 53 of the preselected blade members only. The required positioning of the studs 29 can be achieved either by having a number of chains 25** available with different arrangements of studs 29 for different perforation requirements, and placing the appropriate chain on the machine when required, or by providing that the studs 29 can be repositioned on the chain as desired. In either case, the indexing mechanism is adjustable to provide for different perforation requirements.

Figure 7:
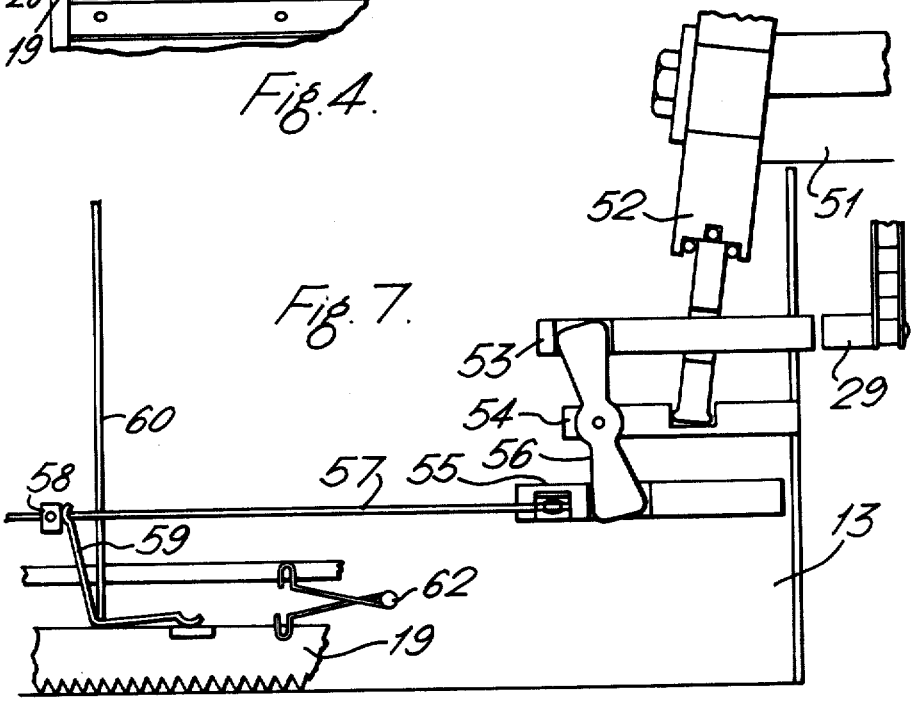
FIG. 7 is a diagrammatic view of the indexing mechanism which is housed within the hollow drum of the machine illustrated in FIGS. 1-6 of the drawings.

After being brought opposite the selected actuating plungers 53, further rotation of the male roller 13 causes the studs 29 to engage the respective plungers 53 which, as will be described with reference to FIG. 7, are caused to project axially out of the roller 13 upon rotation towards the female roller 14. The engagement of the studs 29 with the selected plungers 53 arrests this axial outward movement of the selected plungers with the result that through the linkages coupling the plungers 53 with their associated blade members 19 the latter are caused to project from their slots 20 for entering the recesses 22 in the female roller to perforate the film. Upon rotation of the blade members 19 away from the female roller 14 after perforation, the plungers 53 withdraw into the roller 13 and disengage the studs 29, and the preselected blade members 19 are retracted into their slots 20.

The portion of the indexing mechanism housed within the hollow drum 13 comprises a plurality of blade extension and retraction linkages each coupling a different plunger 53 to a respective blade member 19—one of the linkages being illustrated in FIG. 7. The indexing mechanism further comprises a fixed horizontal shaft 51 secured to the support frame 10 and protruding into the roller 13 wherein it carries a swash plate 52 which does not rotate with the roller 13. Within the roller 13, and adapted to rotate with it, each linkage comprises two plungers 54 and 55 linked together and to the actuating plunger 53 by a lever 56. Attached to the plunger 55 is a rod 57 upon which is mounted a collar 58 which bears against an angular lever 59. The lever 59 pivots on a disc 60 (common to all the linkages) and in turn bears on a nylon bearing plate 61 on the blade 19. The indexing mechanism further comprises a respective torsion spring 62 for each blade member 19 tending to bias the blade member into its retracted position. FIG. 7 shows the relative positions of the various components of the linkage when the blade member 19 is at its further point from the female roller 14, and it will be seen that at this point the blade member 19 is held in its retracted position by the spring 62.

In operation, rotation of the blade member 19 from the furthest point shown in FIG. 7 towards the female roller 14 causes the plunger 54, which is coupled to the fixed swash plate 52, to perform a rightward stroke reaching its furthest rightward position when it is closest to the female roller. Thereafter, the plunger 54 returns to the left to the position shown in FIG. 7 as the blade member 19 is rotated away from the female roller 14 once again.

Assuming that there is no obstruction in the way of actuating plunger 53, the latter will, as a result of the coupling lever 56, also stroke to the right during rotation towards the female roller 14 and return to the left on receding therefrom, since plunger 55 will be held stationary relative to the drum by the bias of the spring 62. Thus in this case the blade member 19 will remain retracted during its approach and recession from the female roller and will not take part in the perforating operation.

On the other hand, when a chain stud 29 is positioned opposite the plunger 53, the stud 29 will at some point in the rotation towards the female roller engage the plunger 53 and arrest the rightward movement thereof. Now, upon further rotation towards the female roller, the plunger 55 will be caused to stroke to the right by the lever 56 instead of the obstructed plunger 53, thereby overcoming the bias of spring 62 and causing the blade member 19 to project from the roller 13. After passing the female roller 14, the plunger 55 will return to the left allowing the blade member 19 to be retracted by the spring 62, and eventually the plunger 53 will disengage the stud 29.

Thus, by suitably choosing the number and positioning of the studs 29 on the chain 25 one can select at will those blade members 19 which are to partake in the perforating operation and those which are not.

It will be readily understood that the machine allows for a wide variation in the length of film between imparted transverse lines of perforations. The indexing mechanism may be adjusted to give the desired length of film by choosing the blade members 19 which will react to the engagement of the actuating 53 plungers to project through the slots. The slots may be positioned around the roller surface typically 1 inch apart. Accordingly on a 24 inch circumference roller, sheets of film may have applied thereto lines of perforations any distance apart from 1 to 24 inches in 1-inch units.

In practice with high density polyethylene film, good quality perforated film with lines of perforation spaced apart at 10 inch intervals has been produced at a through-put rate of 1200 ft. of film per minute through the machine.

While the present invention has been described with particular reference to the production of perforated sheets of high density polyethylene film, it is to be understood that the machine of the present invention also has application in applying spaced apart lines of perforation to other film material or like sheet material.

I claim:

1. A machine for perforating high density polyethylene film material or the like, comprising a feed roller for supplying film material to be perforated from a roll thereof, cooperating male and female rollers between which film material from the feed roller passes for perforation, and a take up means for receiving the perforated film material, the male roller carrying for rotation therewith a plurality of circumferentially spaced blade members, means for mounting each blade for reciprocal motion relative to the surface of the male roller between a first position wherein the blade member projects from the surface of the male roller and a second position wherein the blade member is retracted into the male roller, means for biasing each blade member into one of its first and second positions, an independently operable actuating member linked respectively to each blade member for forcing the associated blade member into the other of its first and second positions in opposition to the biasing means, an indexing mechanism including a plurality of selectively located actuating means mounted for movement in coordination with the rotation of the male roller and arranged to cooperate with the actuating members of the blade members in such manner that upon rotation of the male roller the actuating means are brought successively into engagement with selected actuating members whereby the associated blade members are successively forced into their other positions, means for causing the actuating means to remain in engagement with the actuating members during a partial rotation of the male roller and for thereafter being successively disengaged from the actuating members to allow the biasing means to return the blade members to their one positions, the angular distance over which the actuating means remain in engagement with the selected actuating members being chosen such that, in the vicinity of the female roller, the blade members linked with the selected actuating members are in their projecting position for perforation of film material passing between the male and female rollers and the blade members linked to the non-selected actuating members are in their retracted position, recesses within the female roller which are entered by the selected blade members during perforation of the film, and means for adjusting the indexing means whereby the spacing and number of actuating means may be changed to vary the selection of blade members.

2. A machine as claimed in claim 1, wherein a common swash plate and linkage means couples each actuating member to its associated blade member, said linkage means being operatively positioned relative to said common swash plate such that as each blade member is rotated towards the female roller the biasing means causes the associated actuating member to move relative to the male roller, and wherein the actuating means moves in coordination with the male roller to engage and arrest the movement of the selected actuating members whereby the associated blade members are forced into their other position against the biasing means.

3. A machine as claimed in claim 2, wherein the biasing means biases each blade member into its retracted position, and the actuating means moves in coordination with the male roller to engage the actuating members of the preselected blade members whereby the latter are forced to project from the surface of the male roller.

4. A machine as claimed in claim 3, wherein the actuating means moving in coordination with the male roller comprises a plurality of studs secured at selected locations on an endless chain or belt.

5. A machine as claimed in claim 1, wherein the blade members are disposed parallel to the axis of the male roller and each comprises a plurality of blade heads for producing a line of individual perforations transverse the film material.

* * * * *